United States Patent [19]

Kaji et al.

[11] 4,283,369

[45] Aug. 11, 1981

[54] APPARATUS FOR MAKING PITCH FIBER INFUSIBLE

[75] Inventors: Hisatsugu Kaji; Iwawo Kameyama; Takashi Hamaguti; Tamotsu Miyamori, all of Iwaki, Japan

[73] Assignee: Kureha Kagaku Kogyo Kabushiki Kaisha, Tokyo, Japan

[21] Appl. No.: 109,115

[22] Filed: Jan. 2, 1980

Related U.S. Application Data

[62] Division of Ser. No. 51,191, Jun. 22, 1979.

[30] Foreign Application Priority Data

Jun. 30, 1978 [JP] Japan ..... 53-78555

[51] Int. Cl.[3] ..... B01J 6/00; C10C 3/14; F27B 5/02; F27B 5/06

[52] U.S. Cl. ..... 422/193; 34/240; 422/233; 425/445; 432/128; 432/145; 432/152; 432/253

[58] Field of Search ..... 422/164, 188, 193, 232, 422/233, 235, 237, 310, 189; 432/128, 144, 145, 152, 253, 258, 261; 34/240, 239; 423/447.1, 447.4, 447.6, 447.7; 425/445

[56] References Cited

U.S. PATENT DOCUMENTS

| | | | |
|---|---|---|---|
| 1,949,716 | 3/1934 | Harsch | 432/152 X |
| 2,667,707 | 2/1954 | Kropf | 34/240 X |
| 2,788,542 | 4/1957 | Swalm, Jr. et al. | 432/152 X |
| 2,842,349 | 7/1958 | Ipsen | 432/152 X |
| 3,698,698 | 10/1972 | Kreider et al. | 432/253 |
| 4,016,247 | 4/1977 | Otani et al. | 423/447.6 X |

FOREIGN PATENT DOCUMENTS

| | | | |
|---|---|---|---|
| 643738 | 8/1962 | Italy | 432/152 |
| 908086 | 10/1962 | United Kingdom | 432/152 |

OTHER PUBLICATIONS

W. Watt et al., "The Effect of Length Changes Diving the Oxidation of Polyacrylonitrile Fibers on the Young's Modulus of Carbon Fibers", Applied Polymer Symposia, No. 9, pp. 215–227 (1969).

*Primary Examiner*—Bradley Garris
*Attorney, Agent, or Firm*—Wegner & Bretschneider

[57] ABSTRACT

A method of producing carbon fiber by making infusible and carbonizing pitch fiber which is obtained by melt-spinning petroleum-tar pitch or coal-tar pitch, and a method of making pitch fiber infusible in an air atmosphere containing $NO_2$, at an elevated temperature by introducing a cross-sectionally U-shaped tray with pitch fiber suspended from bars placed across an upper portion thereof into an infusible material producing furnace having gas exchanging chambers in the inlet portion and outlet portion thereof as well as at least two gas circulating means each of which comprises a combination of a blower or a fan and a heat exchanger, and retaining said tray in said furnace.

1 Claim, 2 Drawing Figures

APPARATUS FOR MAKING PITCH FIBER INFUSIBLE

This is a division of application Ser. No. 51,191 filed June 22, 1979.

BACKGROUND OF THE INVENTION

1. Field of the Invention

The present invention relates to an efficient method of and apparatus for producing carbon fiber by making infusible and carbonizing pitch fiber which is obtained by melt-spinning petroleum-tar pitch or coal-tar pitch.

2. Description of the Prior Art

In the production of carbon fiber by melt-spinning petroleum-tar pitch or coal-tar pitch, it has been known that pitch fiber obtained is subjected to a reaction to make it infusible prior to the carbonizing thereof. The pitch fiber is made infusible as it is subjected to a take-up system in which the pitch fiber is fed and taken up around a roll, or a net conveyor system in which the pitch fiber is placed on and transferred by a net conveyor. However, in the take-up system, a high productivity cannot be obtained since the pitch fiber cannot be taken up at a high rate due to the low physical strength and ductility thereof. Moreover, it takes much time to mend pitch fiber when it is broken during the reaction according to this system. In the net conveyor system, the pitch fiber is waved in the form of net and the density of the fiber is increased by the force of gravity (their own weights). This causes the fiber to be locally damaged, and the fiber as a whole is not sufficiently oxidized.

SUMMARY OF THE INVENTION

An object of the present invention is to eliminate the above-mentioned drawbacks encountered in the prior art method of this kind.

Another object of the present invention is to provide a method of making pitch fiber infusible in an excellent manner at a high productivity.

Still another object of the present invention is to uniform the flow rate of a circulation gas in a tray by setting to a level in a suitable range the ratio of the packing density of pitch fiber suspended in the tray to the superficial velocity of the circulation gas in the tray.

A further object of the present invention is to provide an apparatus for making pitch fiber infusible, which permits increasing the productivity of pitch fiber and producing excellent infusible pitch fiber.

According to one aspect of the present invention, there is provided a method of making pitch fiber infusible in an air atmosphere containing $NO_2$, at an elevated temperature in the production of carbon fiber by making infusible and carbonizing pitch fiber which is obtained by melt-spinning petroleum-tar pitch or coal-tar pitch, the method comprising placing bars across an upper portion of a cross-sectionally U-shaped tray, suspending pitch fiber from the bars, introducing the resulting tray into an infusible material producing furnace having gas exchanging chambers in the inlet portion and outlet portion thereof as well as at least two gas circulating means each of which comprises a combination of a blower or a fan and a heat exchanger, and retaining the tray in said furnace.

According to another aspect of the present invention, there is provided an apparatus for making pitch fiber infusible, which comprises an infusible material producing furnace capable of holding a plurality of cross-sectionally U-shaped trays each of which has bars placed across an upper portion thereof with pitch fiber suspended therefrom, the furnace having at least two gas circulating means each of which comprises a blower or a fan and a heat exchanger and each of which is for use in circulating an atmospheric gas to cool the reaction zone, as well as gas exchanging chambers adjacent to the inlet portion and outlet portion thereof.

The above and other objects as well as advantageous features of the invention will become clear from the following description of the preferred embodiments taken in conjunction with the accompanying drawings.

DESCRIPTION OF THE PREFERRED EMBODIMENTS

Figure 1:
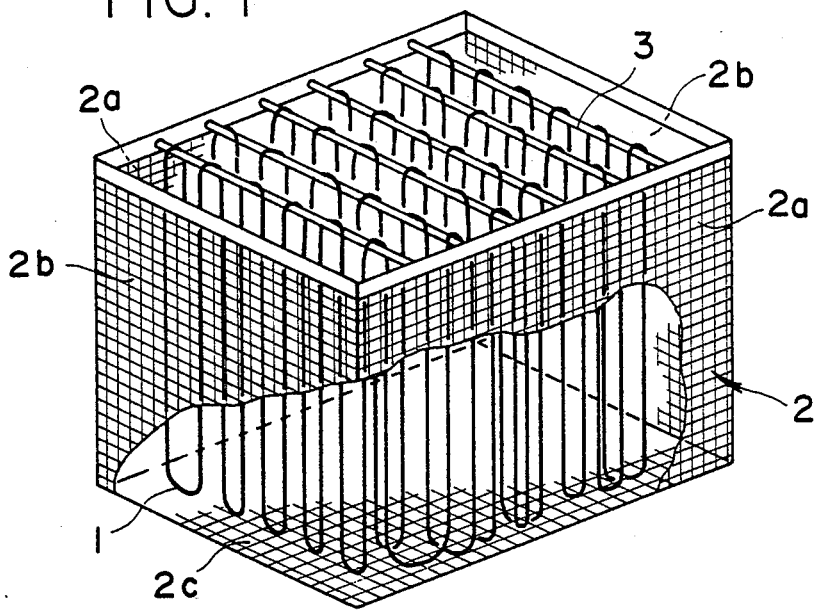
FIG. 1 is a perspective view of a tray used in the present invention, which has bars placed across the upper portion thereof with pitch fiber suspended therefrom.
Figure 2:
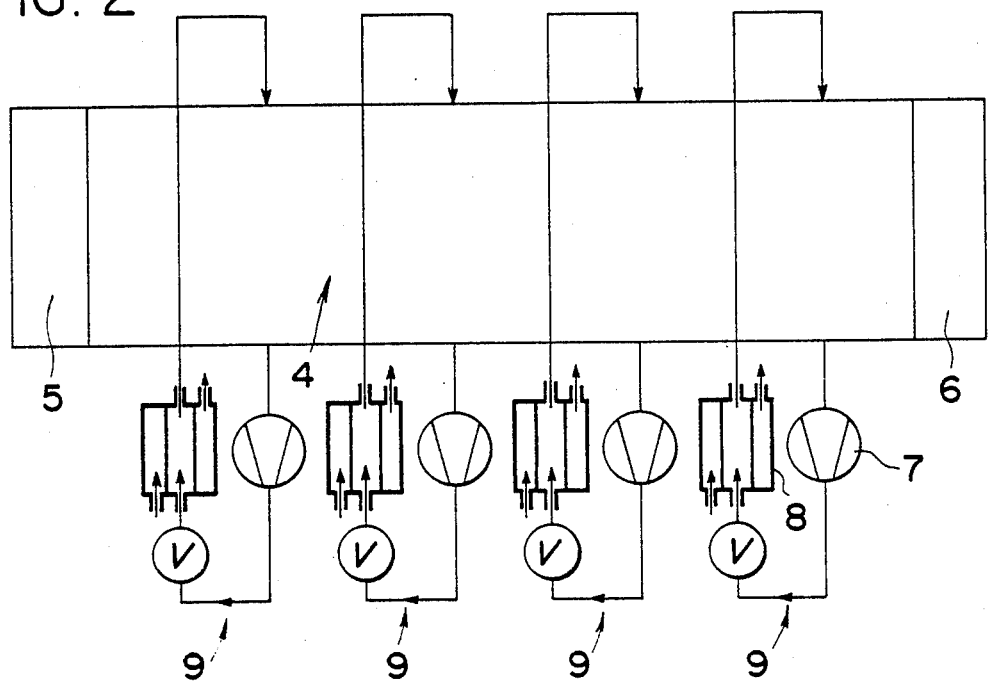
FIG. 2 is a schematic diagram of an apparatus according to the present invention for making pitch fiber infusible.

A cross-sectionally U-shaped tray 2 used in the present invention has four side walls 2*a*, 2*a*, 2*b*, 2*b* and a bottom wall 2*c* which are made of metal net with the upper portion thereof opened as shown in FIG. 1. A plurality of bars 3 are placed across the opened portion of the tray 2, and tow pitch fiber 1 of 10–30 mm in diameter, which is obtained by melt-spinning petroleum-tar pitch or coal-tar pitch, is suspended from the bars 3. The tray 2 with the pitch fiber 1 suspended from the bars 3 is introduced into an infusible material producing furnace 4 as shown in FIG. 2, so as to allow the pitch fiber 1 to be treated as will be described later. The metal net prevents the pitch fiber 1 from contacting, for instance, the wall of the furnace and so deforming, while ensuring passing the circulation gas caused by a circulating means hereinafter mentioned.

The furnace 4 for making materials infusible shown in FIG. 2 consists of a known furnace of this kind, which has been improved with a view to achieving the objects of the present invention. The furnace 4 is capable of holding a plurality of trays 2 and has gas exchanging chambers 5, 6 adjacent to the inlet portion and outlet portion thereof to prevent the composition and temperature of the atmospheric gas in the furnace from being varied when the trays 2 are inserted therein and withdrawn therefrom.

The furnace 4 is constructed such that the atmospheric gas therein has gradually increasing temperatures from the inlet portion thereof toward the outlet portion thereof. The furnace 4 is further provided with blowers or fans 7 which are suitably spaced from one another, and at least two (four in this embodiment) gas circulating means 9 for use in withdrawing the atmospheric gas from a lower portion of the furnace and feed thereinto from an upper portion thereof to thereby produce vertical currents of the atmospheric gas. Each of the gas circulating means 9 has a heat exchanger 8 therein to remove the heat generated during a reaction for making pitch fiber infusible, and thereby maintain constant the temperature of the atmospheric gas in every part of the furnace.

According to the method of the present invention, a tray 2 with pitch fiber 1 suspended from bars 3 as shown in FIG. 1 is introduced into an infusible material producing furnace 4 as shown in FIG. 2, and intermittently transferred in an air atmosphere of 100°-400° C. containing 0.1-10 volume percent of $NO_2$, to make the pitch fiber 1 infusible in 1-4 hours.

The amount (packing density) of pitch fiber 1 suspended in the tray 2 can be arbitrarily varied by changing the suspension intervals. When the amount of pitch fiber 1 is too small, the productivity may be lowered. When the amount of pitch fiber 1 is too large, the reaction for making the pitch fiber infusible may not be uniformly carried out and the atmospheric gas may not flow uniformly during a carbonizing reaction to be conducted thereafter.

This causes the temperature inside the tray 2 to be varied in each part thereof. The amount of pitch fiber 1 is preferably 1-30 kg/m$^3$ and, more preferably, 2-20 kg/m$^3$.

The pitch fiber suspended in a tray and introduced into an infusible material producing furnace to make the pitch fiber infusible is in the form of a tow. Then, when the pitch fiber of a packing density of over 1 kg/m$^3$ is treated with a natural convection of air, a heat removing gas does not flow uniformly in the tow. Accordingly, the heat cannot be removed satisfactorily so that the temperature is varied in each part of the inside of the tow. This causes the physical properties of finished fiber, which is obtained by carbonizing fiber subjected to an infusible material producing reaction, to be varied. In addition, a violent proceeding of a reaction occurs.

In order to prevent the above-mentioned inconveniences, the infusible material producing furnace 4 is provided with gas circulating means 9 each of which has a fan 7 whereby the reaction heat is removed by forced convection into the reaction zone as described above. The furnace 4 is further provided with gas exchanging chambers 5, 6 adjacent to the inlet portion and outlet portion thereof to prevent the composition and temperature of the atmospheric gas in the furnace from being varied when the trays are inserted therein and withdrawn therefrom.

The infusible material producing furnace has an air atmosphere of 100°-400° C. containing 0.1-10 volume percent of $NO_2$, and pitch fiber is detained in the furnace for 1-4 hours to make the same infusible. The conditions restricted here are the same with those that are generally adopted in making the pitch fiber infusible.

In order to practice the present invention, a tray 2 with pitch fiber 1 suspended therein is first introduced into a gas exchanging chamber 5 in which the atmospheric gas is completely exchanged so that the atmospheric gas is rendered identical with the atmospheric gas in the infusible material producing furnace, and the tray is then introduced into the furnace. Consequently, the temperature of the inside of the furnace is not decreased and the composition of the atmospheric gas is not varied. Namely, the pitch fiber 1 can be made infusible uniformly under preferable conditions.

As the reaction for making pitch fiber infusible is progressed, the temperature is increased due to the reaction heat so that the temperature is possibly varied in each part of the inside of the tray. The variation of temperature may be arbitrarily regulated while producing downward current of the atmospheric gas in the tray 2 by blowers or fans 7, to remove the heat with heat exchangers 8. Since the heat removing effect can be improved by regulating the flow rate of the circulation gas, it is possible to reduce the difference between the softening point of pitch fiber and the temperature of the atmospheric gas. This permits the pitch fiber to be made infusible in a short period of time. It is preferable that the circulation gas for use in removing the heat flow in a downward direction. If the gas flows in an undesirable direction, the suspended pitch fiber may be curled up or entangled due to the light weight thereof. This prevents the reaction heat from being removed in a satisfactory manner. Then, a circulation gas flowing downwardly is the most helpful to prevent disorderly movements of the pitch fiber.

When the superficial velocity of the circulation gas in a furnace is too high, the load of a motor may be increased, and the reaction may not be carried out economically. Therefore, the ratio of the packing density (kg/m$^3$) of pitch fiber in the form of tow to the superficial velocity (Nm/sec) of the circulation gas in a furnace is regulated such that the ratio satisfies the following formula.

$$50 > \frac{\text{Packing density of pitch fiber}}{\text{Superficial velocity of circulation gas in a furnace}} > 10$$

It is necessary to increase the superficial velocity of circulation gas in a furnace when the packing density of pitch fiber is high. However, an excessively high superficial velocity of circulation gas in a furnace as compared with the packing density of pitch fiber causes to prevent the reaction from being carried out economically and also causes pitch fiber to be broken in some cases to raise trouble in the processing step.

On the contrary, when the superficial velocity of circulation gas in a furnace is low as compared with the packing density of pitch fiber, the heat-removing gas does not flow uniformly so that the temperature of the pitch fiber is varied in each part thereof. This causes not only the variation in the physical properties in each part of carbonized fiber but also the violent proceeding of the reaction. A preferably superficial velocity of circulation gas is 0.05-2.0 Nm/sec. In other words, it is preferable to operate the furnace at a superficial velocity of circulation gas of a level in the above range and satisfying the formula shown above.

When the temperature of the infusible material producing reaction is closer to the softening point of pitch fiber, the reaction may be carried out in shorter period of time. However, when the reaction temperature is too close to the softening point, it becomes difficult to locally suppress the reaction, and a violent proceeding of a reaction may occur.

On the contrary, when the difference between the reaction temperature and the softening temperature of the pitch fiber is too large, the reaction time becomes long. This makes it necessary to increase the dimensions of the reactor to a considerable extent. A preferable reaction temperature is lower than the softening point of pitch fiber by 5°-50° C.

When pitch fiber having a softening point of around 165° C., which is made from a polymerized pitch obtained by heat-treating, for example, naphtha tar, is subjected to an infusible material producing furnace, a preferable reaction temperature at the inlet portion of the furnace is 160°-115° C. In this case, it is recommendable to increase the reaction temperature so that the difference between the reaction temperature and the softening point, which is gradually increased as the reaction progresses, of the pitch fiber may become substantially constant, until the softening temperature has attained around 300° C. However, it is preferable to regulate the reaction temperature so that it may be not over 350° C. and, more preferably, not over 300° C. When the reaction temperature is extremely high, a reaction for polymerizing the pitch fiber may occur in addition to the reaction for making the pitch fiber infusible. This causes to produce carbon fiber, a final product, having low physical strength and ductility.

According to the present invention, trays with pitch fiber suspended therein are introduced in order into an infusible material producing furnace via a gas exchanging chamber 5, and the trays in the front portion of the furnace are thereby intermittently transferred as they are subjected to an infusible material producing reaction. The trays are forced out into a gas exchanging chamber on the side of the outlet when the reaction has been completed. Then, the trays are withdrawn from the gas exchanging chamber while shutting off the chamber against the furnace body so that no outer air may enter the furnace body. The pitch fiber is then carbonized in a carbonizing furnace to be turned into carbon fiber products.

EXAMPLE 1

In each of trays of 1.2 m in height and 1.44 $m^2$ in sectional area as shown in FIG. 1 was suspended 7.0 kg of pitch fiber obtained from naphtha tar. The resulting trays were introduced into an infusible material producing furnace as shown in FIG. 2, which is capable of holding 14 trays. These trays were introduced one by one every 17 minutes into an air atmosphere in the furnace of 100°-250° C. containing 1.0 volume percent of $NO_2$, and each tray was withdrawn from the furnace 4 hours after it had been introduced thereinto. As a result, excellent infusible pitch fiber was obtained. During the above reaction, the superficial velocity of the circulation gas in a furnace 0.25 Nm/sec.

EXAMPLE 2

The same infusible material producing reactions as in Example 1 were conducted with varying the packing density ($\rho$) of pitch fiber, the difference ($\Delta t$) between the softening point of pitch fiber and reaction temperature and the superficial velocity (Ug) of circulation gas in a furnace, in an air atmosphere of 100°-250° C. containing 1.0 volume percent of $NO_2$. The results of these reactions are shown in the following table as Example No. A-D. The reaction time required for these Examples A-D is also shown in the table.

EXAMPLE 3

The same infusible material producing reaction as in Example 1 was conducted in an air atmosphere of 100°-250° C. containing 5.0 volume percent of $NO_2$. The result of this reaction is shown in the table as Example No. E.

The same reactions were conducted as Comparative Examples F.G under the same conditions except that $\rho$, $\Delta t$ and Ug were further changed. The reaction time required for these reactions will also be shown in the table below.

TABLE

| Example No. | $\rho$(kg/$m^3$) | Ug(Nm/sec) | $\Delta t$ (°C.) | Reaction time (h) |
|---|---|---|---|---|
| A | 4.0 | 0.13 | 40 | 4.0 |
| B | 4.0 | 0.20 | 25 | 3.0 |
| C | 4.0 | 0.33 | 15 | 1.8 |
| D | 10.0 | 0.50 | 25 | 3.0 |
| E | 18.0 | 0.50 | 25 | 2.0 |
| F (Comparative Example) | 2.0 | 0.03 | 40 | 7.0 |
| G (Comparative Example) | 10.0 | 0.20 | 50 | 8.2 |

The present invention is not, of course, limited to the above embodiments; it may be modified in various ways within the scope of the appended claims.

What is claimed is:

1. An apparatus for making pitch fibers infusible, comprising:

a furnace for producing infusible materials holding a plurality of trays, each of said trays having side and bottom walls made of a metal net material and having an open upper end across which is placed a plurality of spaced bars for suspending said pitch fibers, said furnace having an inlet and an outlet;

at least two gas circulating means for exhausting gas heated during the infusibilization of said pitch from a lower portion of said furnace and returning the gas to an upper portion of said furnace, thus maintaining the temperature of the gas in said furnace constant in each part of said furnace, each of said gas circulating means comprising a blower or fan and a heat exchanger; and a gas exchanging chamber adjacent to each of said inlet and said outlet.

* * * * *